US007837438B2

(12) United States Patent
Campbell

(10) Patent No.: US 7,837,438 B2
(45) Date of Patent: Nov. 23, 2010

(54) VANE ASSEMBLY WITH METAL TRAILING EDGE SEGMENT

(75) Inventor: Christian X. Campbell, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 443 days.

(21) Appl. No.: 11/901,551

(22) Filed: Sep. 18, 2007

(65) Prior Publication Data

US 2009/0003988 A1 Jan. 1, 2009

Related U.S. Application Data

(62) Division of application No. 11/101,255, filed on Apr. 7, 2005, now Pat. No. 7,316,539.

(51) Int. Cl.
*F01D 1/02* (2006.01)

(52) U.S. Cl. ..... 415/191; 415/200

(58) Field of Classification Search ..... 415/115, 415/191, 200, 209.4, 210.1, 211.2, 241 R, 415/231 B; 416/23

See application file for complete search history.

(56) References Cited

U.S. PATENT DOCUMENTS

| | | | | | |
|---|---|---|---|---|---|
| 3,447,763 | A | | 6/1969 | Allcock | |
| 3,466,725 | A | | 9/1969 | Kock | |
| 3,619,077 | A | * | 11/1971 | Wile et al. | 415/115 |
| 3,756,540 | A | | 9/1973 | Williams | |
| 3,867,065 | A | | 2/1975 | Schaller et al. | |
| 3,992,127 | A | | 11/1976 | Booher, Jr. et al. | |
| 4,006,999 | A | | 2/1977 | Brantley et al. | |
| 4,136,846 | A | | 1/1979 | Brault | |
| 4,213,587 | A | | 7/1980 | Roeseler et al. | |
| 4,311,291 | A | | 1/1982 | Gilbertson et al. | |
| 4,314,442 | A | * | 2/1982 | Rice | 60/775 |
| 4,565,490 | A | * | 1/1986 | Rice | 415/114 |
| 4,667,906 | A | | 5/1987 | Suarez et al. | |
| 4,671,471 | A | | 6/1987 | Patmont | |
| 4,741,542 | A | | 5/1988 | Kimerly | |
| 4,861,229 | A | | 8/1989 | Halstead | |
| 4,871,132 | A | | 10/1989 | Finsterwalder | |
| 4,897,020 | A | * | 1/1990 | Tonks | 415/115 |
| 5,090,866 | A | * | 2/1992 | Blair | 415/115 |
| 5,224,670 | A | | 7/1993 | Padden | |
| 5,358,379 | A | * | 10/1994 | Pepperman et al. | 415/191 |

(Continued)

FOREIGN PATENT DOCUMENTS

JP 11141305 A 5/1999

*Primary Examiner*—Edward Look
*Assistant Examiner*—Aaron R Eastman

(57) ABSTRACT

Embodiments of the invention relate to a vane assembly formed by a forward airfoil segment and an aft airfoil segment. The aft segment is made of metal and can define the trailing edge of the vane assembly. The forward segment can be made of ceramic, CMC or metal. The forward and aft segments cannot be directly joined to each other because of differences in their rates of thermal expansion and contraction. The forward and aft segments can be positioned substantially proximate to each other so as to form a gap therebetween. In one embodiment, the gap can be substantially sealed by providing a coupling insert or leaf springs in the gap. A separate metal aft segment can take advantage of the beneficial thermal properties of the metal to improve cooling efficiency at the trailing edge without limiting the rest of the vane to being made out of metal.

11 Claims, 8 Drawing Sheets

U.S. PATENT DOCUMENTS 5,531,406 A 7/1996 Redekopp
5,538,202 A 7/1996 Thornburg
5,827,045 A * 10/1998 Beeck ..... 416/96 A
5,931,636 A 8/1999 Savage et al.
6,013,592 A 1/2000 Merrill et al.
6,045,325 A 4/2000 Horvath et al.
6,200,092 B1 * 3/2001 Koschier ..... 415/191
6,234,423 B1 5/2001 Hirahara et al.
6,235,370 B1 5/2001 Merrill et al.
6,287,511 B1 9/2001 Merrill et al.
6,325,593 B1 12/2001 Darkins, Jr. et al.
6,331,217 B1 12/2001 Burke et al.
6,514,046 B1 * 2/2003 Morrison et al. ..... 416/229 A
6,543,996 B2 * 4/2003 Koschier ..... 415/200
6,607,358 B2 8/2003 Finn et al.
6,641,907 B1 11/2003 Merrill et al.
6,648,597 B1 11/2003 Widrig et al.
6,670,046 B1 12/2003 Xia
6,676,783 B1 1/2004 Merrill et al.
6,689,246 B2 2/2004 Hirahara et al.
6,709,230 B2 3/2004 Morrison et al.
6,733,907 B2 5/2004 Morrison et al.
6,764,047 B2 7/2004 Miller et al.
7,143,983 B2 12/2006 McClure
7,393,183 B2 * 7/2008 Keller ..... 416/224
7,452,182 B2 * 11/2008 Vance et al. ..... 415/135
2002/0100839 A1 8/2002 Miller et al.
2002/0155269 A1 10/2002 Holowczak et al.
2004/0011927 A1 1/2004 Christman et al.
2004/0062636 A1 4/2004 Mazzola et al.
2005/0274848 A1 12/2005 Friddell et al.
2006/0145010 A1 7/2006 Schmidt et al.
2006/0226290 A1 10/2006 Campbell
2007/0063109 A1 3/2007 Arnaud

* cited by examiner

VANE ASSEMBLY WITH METAL TRAILING EDGE SEGMENT

CROSS REFERENCE TO RELATED APPLICATIONS

This is a divisional application of U.S. patent application Ser. No. 11/101,255, filed Apr. 7, 2005, which is incorporated by reference herein.

FIELD OF THE INVENTION

The invention relates in general to turbine engines and, more particularly, to turbine vanes.

BACKGROUND OF THE INVENTION

During the operation of a turbine engine, turbine vanes, among other components, are subjected to high temperature combustion gases. The vanes can be made of any of a number of materials, and each material can provide certain advantages in managing the thermal loads imposed on the vane. However, at least from a thermal design standpoint, experience has demonstrated that no single material is ideal for every portion of the vane. Thus, there is a need for a vane construction that can facilitate the selective incorporation of dissimilar materials in a turbine vane.

SUMMARY OF THE INVENTION

In one respect, aspects of the invention relate to an airfoil assembly. The airfoil assembly includes a forward airfoil segment and an aft airfoil segment. The forward airfoil segment defines the leading edge of the airfoil assembly. The forward airfoil segment can be made of one of ceramic, ceramic matrix composite, metal, or single crystal super alloy. In one embodiment, the forward airfoil segment can include a substantially solid core surrounded by a ceramic matrix composite wrap. The aft airfoil segment defines the trailing edge of the airfoil assembly. The aft airfoil segment is made of metal. The airfoil segments are positioned substantially proximate to each other so as to form a gap therebetween.

An insert is disposed in the gap and is secured to one of the airfoil segments. Thus, the insert substantially seals the gap and provides compliance between the forward and aft airfoil segments. The insert can engage the forward and aft segments in compression at substantially all points of contact between the insert and the forward and aft segments. The insert can include at least one coolant exit passage in fluid communication with a coolant plenum in the forward segment. The coolant exit passage can be configured to direct a coolant from the plenum over the aft segment so as to cool the aft segment. The exit passage can be formed entirely within the insert. Alternatively, at least a portion of the exit passage can be formed between the insert and the interface surface of the aft segment.

In one embodiment, a metal support can be disposed inside of the forward airfoil segment. The metal support and the aft airfoil segment can be rigidly connected by one or more rods. Thus, the aft segment can be stiffened against bending forces.

The forward airfoil segment can include a coolant plenum. At least one passage can connect between the plenum and the gap. The insert can include at least one hollow protrusion having an expanded head. The insert can be positioned in the passage such that the expanded head protrudes into the plenum so as to secure the insert to the forward airfoil segment.

Aspects of the invention are directed to another airfoil assembly. The assembly includes a forward airfoil segment that defines the leading edge of the airfoil assembly at one end and provides an interface surface at an opposite end. The forward airfoil segment can be made of one of ceramic, ceramic matrix composite, metal, or single crystal super alloy. In one embodiment, the forward airfoil segment can include a substantially solid core surrounded by a ceramic matrix composite wrap.

The assembly also includes an aft airfoil segment that defines the trailing edge of the airfoil assembly at one end and provides an interface surface at the opposite end. The aft airfoil segment is made of metal. The interface surfaces of the airfoil segments are positioned substantially proximate to each other so as to form a gap therebetween. The interface surface of the forward segment substantially matingly corresponds to the interface surface of the aft segment.

A sealing device is positioned in at least a portion of the gap. The sealing device can be one of a leaf spring and a resilient insert. The sealing device is held in compression at least by the substantially mating interface surfaces. Thus, the sealing device substantially seals the gap and provides compliance between the forward and aft airfoil segments.

In one embodiment, at least a portion of each of the interface surfaces can be substantially correspondingly tapered. Further, the forward airfoil segment can be radially biased such that the respective interface surface is urged toward the other interface surface, thereby holding the sealing device in compression. In one embodiment, the interface surfaces can be substantially matingly serpentine. Thus, the serpentine interface surfaces can create a tortuous gap between the forward and aft airfoil segments so as to impede flow through the gap.

The aft segment can include a coolant supply plenum and an exit chamber. The exit chamber can open to the trailing edge of the vane assembly, and the coolant supply plenum can be in fluid communication with the exit chamber. In one embodiment, the exit chamber can include a series of transverse rods so as to form a pin-fin cooling array.

The vane assembly can further include a first shroud and a second shroud. The aft segment can include opposing radial ends. One radial end of the aft segment can be fixed to the first shroud, and the opposite radial end of the aft segment can operatively engage the second shroud so as to permit radial movement of the aft segment relative to the second shroud. Thus, thermal expansion of the aft segment in the radial direction can be accommodated.

DETAILED DESCRIPTION OF EMBODIMENTS OF THE INVENTION

Figure 1:
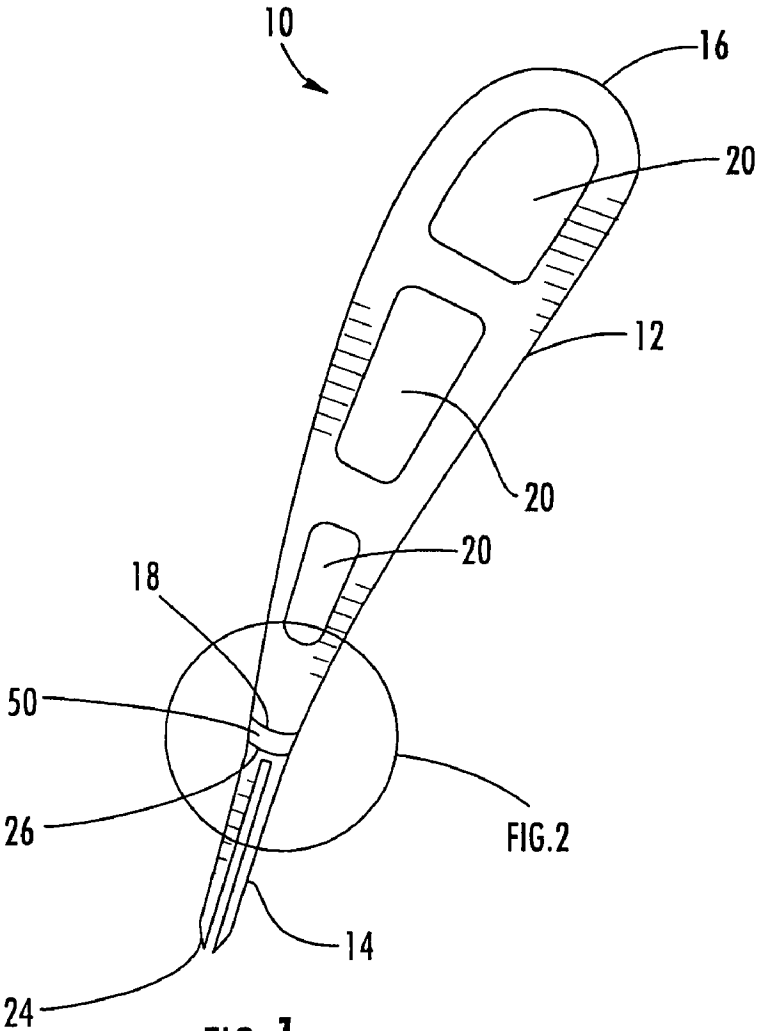
FIG. 1 is a top plan view of one vane assembly according to embodiments of the invention.

Embodiments of the present invention provide a vane construction that facilitates the selective incorporation of different materials in a turbine vane, particularly a vane with a separate metal trailing edge piece. Embodiments of the invention will be explained in the context of two possible vane assemblies, but the detailed description is intended only as exemplary. Embodiments of the invention are shown in FIGS. 1-9, but the present invention is not limited to the illustrated structure or application.

There are several material systems that can be beneficial to certain portions of a turbine vane. For example, ceramic matrix composites (CMC) are desirable because of their low thermal conductivity characteristics. When covered with a thermal insulating material, a CMC vane can be cooled with a minimal amount of cooling air because of their low heat transfer coefficients combined with their high temperature capability. The thermal insulating material can be a friable graded insulation, such as disclosed in U.S. Pat. Nos. 6,676,783; 6,641,907; 6,287,511; and 6,013,592, which are incorporated herein by reference. CMC materials are well suited for the forward portion of a vane, but they are not as suitable for the trailing edge portion of the vane. From an aerodynamics standpoint, the trailing edge of a vane should be as thin as possible. But, in order to provide a sufficiently thin CMC trailing edge in a CMC vane, the trailing edge region must either remain uncoated or only a thin layer of thermal insulating material can be applied. In either case, the trailing edge cannot be effectively insulated. As a result, it becomes increasingly difficult to cool the trailing edge.

Fabrication of a CMC trailing edge is difficult because of the tight radius of curvature at the trailing edge and compaction issues, which can lead to compromised CMC properties. In addition, the internal passages of the vane are pressurized, so the vane must carry the tensile pressure loads in the interlaminar direction—the weakest direction of a CMC material. The inclusion of cooling passages in the CMC vane can compromise the CMC properties and result in stress concentrations in the already weak interlaminar direction. Moreover, it is difficult to maintain internal pressure within a thin cross-section of porous CMC material because of leakage. Due to these constraints, only simple cooling schemes, such as straight cooling holes, can be used in CMC airfoils, thereby limiting the heat transfer coefficient available for cooling.

In contrast, metals are well suited for the trailing edge portion of a vane. A metal trailing edge can permit the inclusion of more efficient cooling arrangements, such as pin-fin cooling, that can provide high heat transfer coefficients. In addition, a thin wall, highly conductive thermal barrier coating applied over the vane can keep the temperatures on the vane below the temperature limit of the metal. Though well suited for the thin trailing edge portion of a vane, metals are not as desirable for the relatively thick forward body of the vane, which is directly impinged upon by high temperature gases. Due to the relatively low temperature limit of metals and the high heat transfer coefficients, a metal forward body of the vane is difficult to cool. As a result, inefficient cooling schemes, such as film cooling, must be used to cool the thick metal walls to keep the temperatures on the vane below the temperature limit of the metal.

A vane assembly according to embodiments of the invention can be configured to selectively take advantage of the desired thermal attributes of metals, CMCs and other materials. One embodiment of a vane assembly according to aspects of the invention is shown in FIGS. 1-5. The vane assembly 10 can be made of at least two segments. Each segment can be elongated in the radial direction. The term "radial," as used herein, is intended to mean radial to the turbine when the vane assembly is installed in its operational position. In one embodiment, shown in FIG. 1, the vane assembly 10 can include a forward airfoil segment 12 and an aft airfoil segment 14. The terms "forward" and "aft" refer to the position of the segments relative to the oncoming gas flow in the turbine. Each of the airfoil segments 12, 14 will be discussed in turn below.

The forward airfoil segment 12 can be generally airfoil-shaped. It will be understood that embodiments of the invention are not limited to any particular airfoil conformation. One end of the forward segment 12 can define the leading edge 16 of the vane assembly 10. The opposite end of the forward segment 12 can provide an interface surface 18. The interface surface 18 can have any of a number of configurations. In one embodiment, the interface surface 18 can be substantially flat. In another embodiment, the interface surface 18 can be rounded.

The forward segment 12 can be substantially solid or it can be substantially hollow. In one embodiment, one or more plenums 20 can be provided in the forward airfoil segment 12. The plenums 20 can extend radially through the forward segment 12. The plenums 20 can extend in other directions as well including axially and/or circumferentially. The plenums 20 can have any of a number of conformations. Further, the plenums 20 can be provided for various purposes including for supplying a coolant. At least one of the radial ends of each plenum 20 can be connected to a coolant source (not shown) that can be external the vane assembly 10. A passage 22 can extend through the forward segment 12, extending from the plenum 20 and opening to the interface surface 18 of the forward segment 12. In one embodiment, the passage 22 can be substantially circular, but other cross-sectional geometries are possible. For example, the passages 22 can be elongated in the radial direction R. The passage 22 may or may not be substantially straight. Further, the cross-sectional area of the passage 22 can be substantially constant, or it can vary along the passage 22. If multiple passages 22 are provided, the passages 22 can be substantially identical to each other, or they can be different in one or more respects.

There can be any of a number of such passages 22. It is preferred if the passages 22 are radially spaced along the interface surface 18. In one embodiment, the passages 22 can be substantially equally spaced from each other. Alternatively, the passages 22 can be provided at any regular or irregular interval. The passages 22 can be substantially aligned in the radial direction, or at least one of the passages 22 can be circumferentially offset from the other passages 22 along the radial direction R. Further, the passages 22 can be arranged in various ways. For instance, the passages 22 can be arranged in one or more radial columns.

The forward airfoil segment 12 can be made of any of a number of materials. For instance, the forward airfoil segment 12 can be made of ceramics, ceramic matrix composites (CMC) or metals, just to name a few possibilities. Aspects of the invention are not limited to any particular material for the forward airfoil segment 12. It will be appreciated that the material selection for the forward segment 12 can dictate the manner in which the forward segment 12 is made. For instance, if the forward segment 12 is made of a single crystal super alloy, then the forward segment 12 can be formed by casting; if the forward segment 12 is made of CMC, then the forward segment 12 can be made by a lay-up process.

The aft airfoil segment 14 can define the trailing edge 24 of the vane assembly 10. The aft segment 14 can be generally triangular in conformation, culminating in the trailing edge 24 at one end. At the opposite end, the aft segment 14 can provide an interface surface 26. The interface surface 26 can have any of a number of configurations, such as substantially flat or rounded.

Preferably, the aft airfoil segment 14 is made of metal. The aft segment 14 can be substantially solid or it can have a hollow interior. FIG. 1 shows one possible hollow aft segment 14 design that forms a split trailing edge 24. Alternatively, the trailing edge 24 can have a plurality of radially spaced channels. Further, the aft segment 14 can include any of a number of features, such as a pin-fin cooling array. The aft segment 14 can be formed in various ways, such as by casting.

Figure 3:
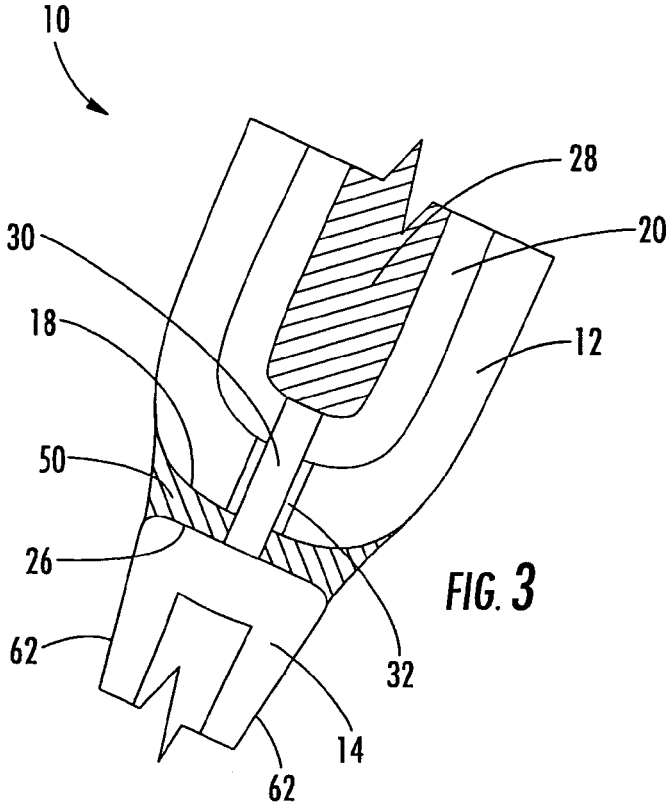
FIG. 3 is a close up view of the interface between a forward airfoil segment and a metal aft airfoil segment according to embodiments of the invention, showing a rigid attachment between the metal aft airfoil segment and a metal support structure inside of the forward airfoil segment.

It should be noted that the axial length of the aft segment 14 can be substantially shorter than the axial length of the forward airfoil segment 12. Ideally, the length of the aft segment 14 is kept relatively small to minimize the surface area of the metal exposed to the hot combustion gases. Consequently, the aft segment 14 may be relatively flimsy, that is, the aft portion 14 can have a low resistance to bending. If necessary, the aft segment 14 can be stiffened against bending forces. To that end, the aft segment 14 can be attached to a metal support, such as a spar 28, provided inside of the forward segment 12. For instance, the spar 28 can reside within one of the plenums 20, as shown in FIG. 3. The aft segment 14 and the spar 28 can be connected to form a rigid connection. In one embodiment, the spar 28 and the metal aft segment 14 can be joined by one or more connecting rods 30 secured to each of these components 14, 28. Securement of the connecting rods 30 to the spar 28 and aft segment 14 can be achieved in a number of ways including, for example, welding, brazing and/or threaded engagement.

To accommodate the connecting rod 30, a passage 32 can be provided in the forward airfoil segment 12. Like the above-described passages 22, the passage 32 can extend from one of the plenums 20 and open to the interface surface 18 of the forward segment 12. The passage 32 can have any of a number of cross-sectional geometries. Naturally, the passage 32 can be sized to receive the connecting rod 30. In addition, the passage 32 can be sized to account for any differences in thermal growth and contraction between the connecting rod 30 and the forward segment 12.

Figure 4:
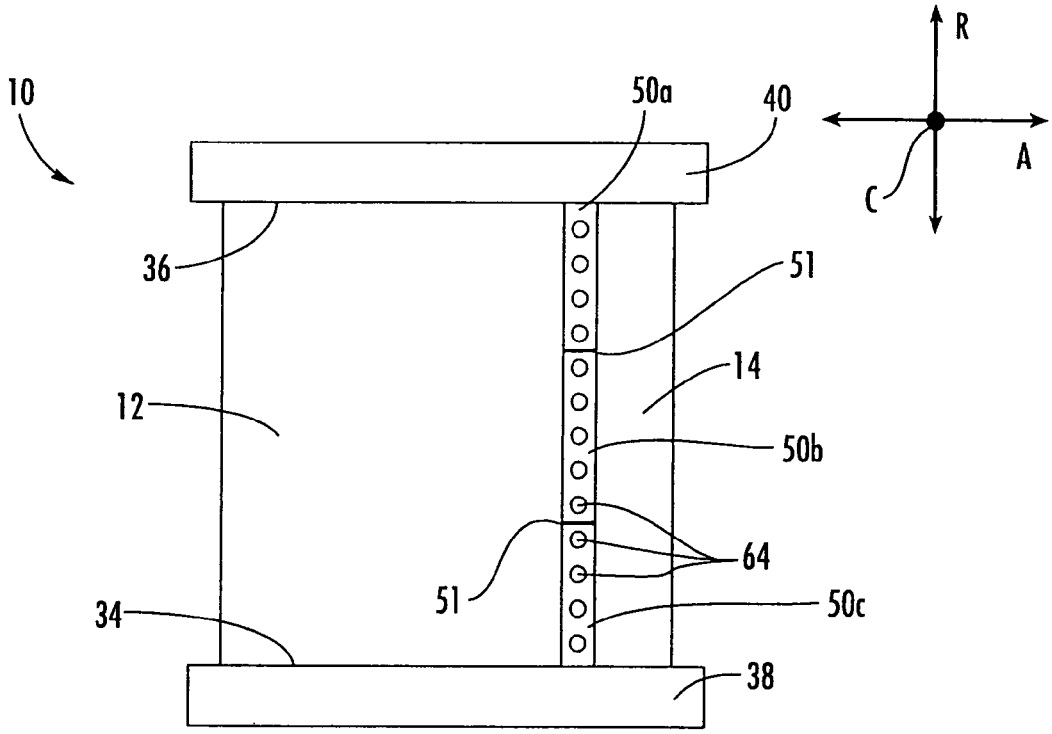
FIG. 4 is a side elevational view of the vane assembly of FIG. 1, showing a plurality of coolant exit holes in a multi-segment compliant insert according to embodiments of the invention.

The forward and aft airfoil segments 12, 14 can be bounded at their radial inner and outer ends 34, 36 by an inner shroud 38 and an outer shroud 40, respectively, as shown in FIG. 4. The inner and outer shrouds 38, 40 can have any of a number of shapes, as will be understood by one skilled in the art. Ideally, at least one end of each of the forward and aft airfoil segments 12, 14 is attached to a respective shroud 38, 40. Similarly, in embodiments in which a metal support, such as a spar 28, is provided inside of the forward segment 12, the support can be attached at one or both of its radial ends to a respective shroud 38, 40. Attachment to the shrouds 38, 40 can be achieved by, for example, welding, fasteners or mechanical engagement.

Figure 5:
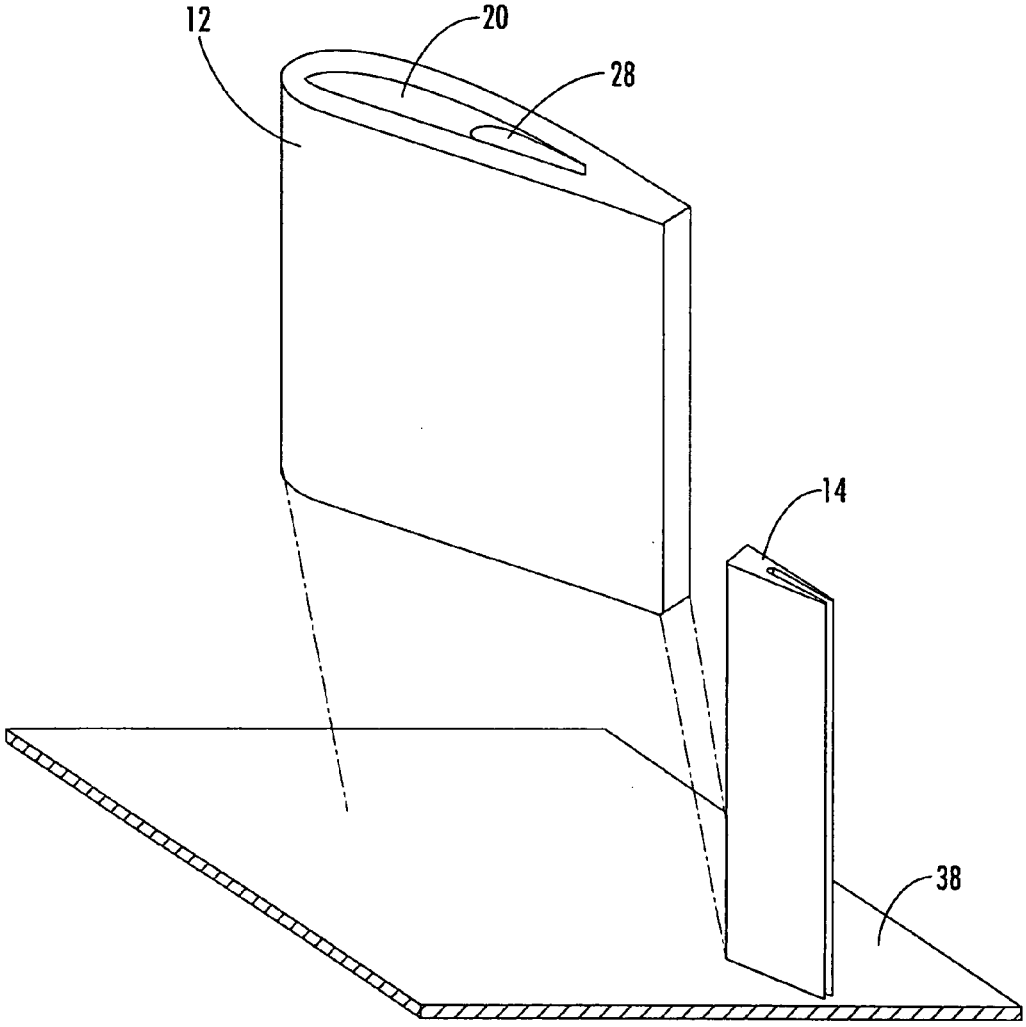
FIG. 5 is an isometric view of a vane assembly having an aft segment fixed at one end to a shroud according to embodiments of the invention.

The shrouds 38, 40 can be unitary parts, or they can be made of multiple components. The inner and outer shrouds 38, 40 can be made of different materials. Preferably, one of the shrouds 38, 40 is made of substantially the same material as the aft segment 14 or a material that is weldably compatible with the material of the aft segment 14. For example, the inner shroud 38 and the metal aft segment 14 can be made of metal. In such case, the metal aft segment 14 can be attached directly to the inner shroud 38, as shown in FIG. 5. The metal aft segment 14 can be secured to the inner shroud 38 in any of a number of ways, including welding.

The metal aft airfoil segment 14 and the forward airfoil segment 12 cannot be rigidly attached to each other due to differences in their coefficients of thermal expansion, particularly when the forward segment 12 is made from CMC and the aft segment 14 is made of metal. Thus, the aft segment 14 remains detached from the forward segment 14. However, the segments 12, 14 can be positioned substantially proximate to each other such that a gap 48 is defined therebetween. For instance, the interface surface 18 of the forward segment 12 can be positioned substantially proximate to the interface surface 26 of the aft segment 14. However, it is unacceptable to have the gap 48 between the forward and aft airfoil segments 12, 14 during engine operation. If present, hot gases in the turbine would seek to flow through the gap 48 due to the large pressure differentials between the pressure side P and the suction side S of the vane assembly 10. As a result, there would be appreciable reductions in aerodynamic performance and a host of additional cooling issues would be presented.

To avoid such problems, a coupling insert 50 can be provided in the gap 48. The insert 50 can fill substantially the entire gap 48 or a portion of the gap 48. The insert can act as a seal between the pressure side P and the suction side S of the vane assembly 10. The insert 50 can be made of any of a number of materials, and embodiments of the invention are not limited to any specific material. However, it is preferred if the material is oxidation resistant and has high temperature properties. Also, it is preferred if the material is resilient and compressible so as to provide compliance for relative movement that can occur between the two airfoil segments 12, 14 during engine operation. In one embodiment, the coupling insert 50 can be made of an iron-based super alloy with high oxidation resistance, such as PM2000. Alternatively, the coupling insert 50 can be made of a cobalt-based super alloy. The coupling insert 50 can be made using any of a number of processes including powder metallurgy or casting, just to name a few possibilities.

The insert 50 can be secured to one of the forward segment or the aft segment 12, 14. Securement of the insert 50 reduces the likelihood that the insert 50 will liberate during engine operation, which can result in costly shut-down and repairs. The insert 50 can be secured to one of the segments 12, 14 in various ways. In one embodiment, the insert 50 can be brazed or bonded to the aft segment 14.

Figure 2B:
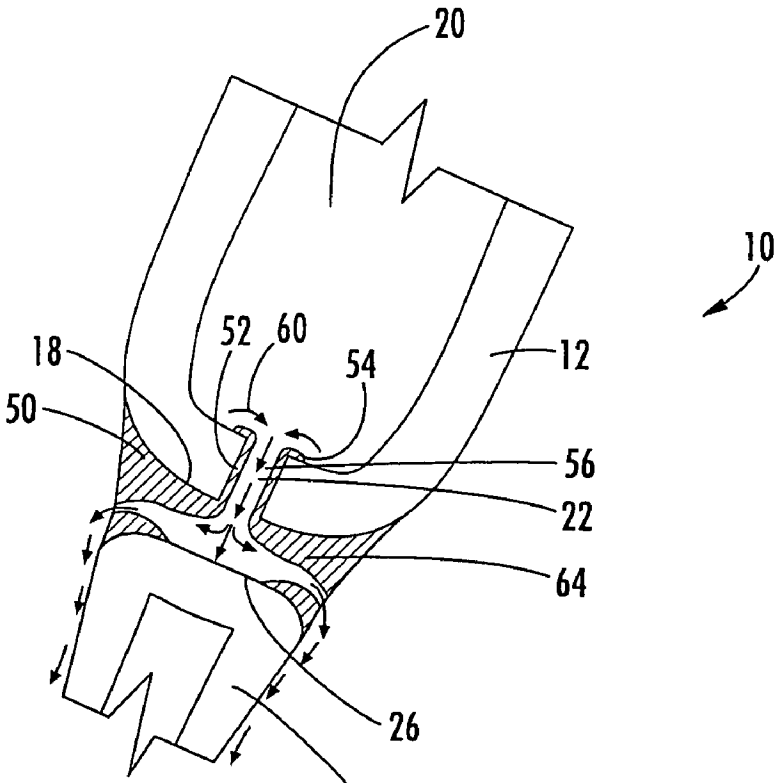
FIG. 2B is a close up view of an interface between a forward airfoil segment and a metal aft airfoil segment according to embodiments of the invention, showing a compliant insert between the airfoil segments in which part of a coolant exit passage is formed between the insert and the interface surface of the aft airfoil segment.
Figure 2A:
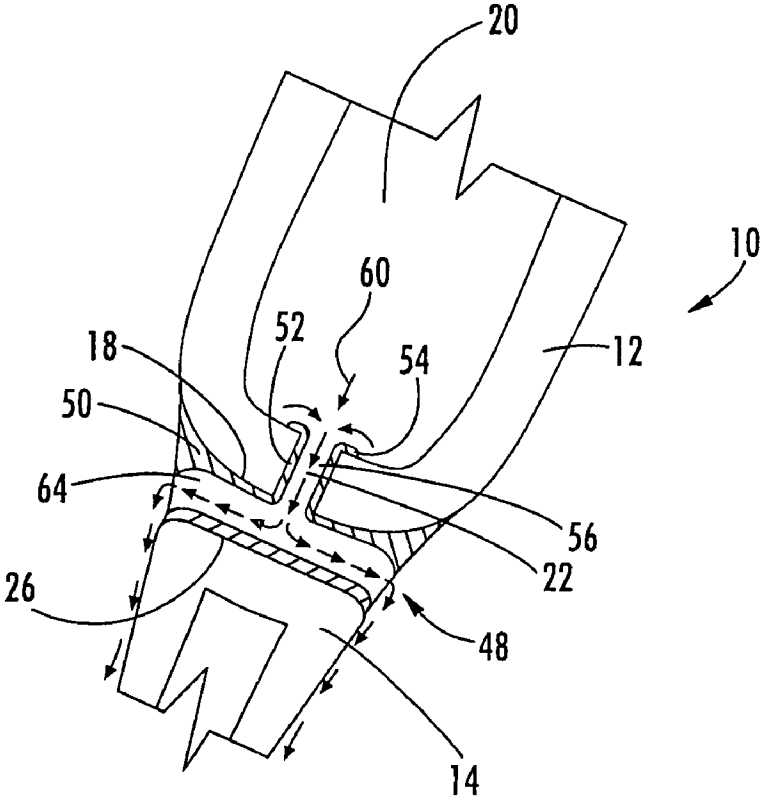
FIG. 2A is a close up view of an interface between a forward airfoil segment and a metal aft airfoil segment according to embodiments of the invention, showing a compliant insert between the airfoil segments with a coolant exit passage formed in the insert.

In one embodiment, the insert 50 can be secured to the forward segment 12 using a principle that is substantially similar to the principle behind blind fasteners. More specifically, the insert 50 can include a number of protrusions 52 on one side of the insert 50. The distal ends 54 of each protrusion 52 can be flared, curled or otherwise extending outward. A passage 56 can extend through each protrusion 52 and can be in fluid communication with one of more passages 64 in the body of the insert 50. The protrusions 52 can be provided so as to correspond to the passages 22 provided in the forward segment 12. However, embodiments of the invention are not limited to a one to one correspondence between the passages 22 and the protrusions 52. Thus, the protrusions 52 can be inserted into the passages 22 in the forward segment 12. The protrusions 52 may need to be compressed in order to be passed through the passages 22. Once the distal end 54 of the protrusion 52 extends into the plenum 20, the protrusion 52 may no longer be readily removed from the passage 22, as shown in FIG. 2A. One or more protrusions 52 can also be provided for any passages 32 that are provided to accommodate the connecting rods 30. It should be noted that the passages 22 and/or the passages 32 can be radially elongated or otherwise radially slotted to accommodate thermal expansion of the insert 50 in the radial direction R. Thus, if the insert 50 expands in the radial direction R, the protrusions 52 can radially slide within the passages 22, 32.

In some instances, it may be beneficial to split the coupling insert 50 into at least two distinct segments as opposed to having one large insert. Because thermal stress is a function of length, a segmented insert 50 can minimize the buildup of large thermal stress over the radial length of the insert 50. One example of a segmented insert 50 made up of three segments 50*a*, 50*b*, 50*c* is shown in FIG. 4. One insert segment can substantially abut an adjacent insert segment along a seam 51 in the axial direction A and/or the circumferential direction C relative to the turbine. Each of the insert segments 50*a*, 50*b*, 50*c* can be secured to one of the interface surfaces 18, 26 in any of the manners discussed above.

Preferably, the insert 50 is adapted to matingly engage at least a portion of the forward segment 12 in compression. It is further preferred if such compressive engagement occurs at substantially all points of contact between the forward segment 12 and the insert 50. Similarly, the other side of the insert 50 can be adapted to matingly engage the aft segment 14 of the vane assembly 10. With the insert 50 in place, it will be appreciated that the gap 48 between the forward and aft segments 12, 14 can be substantially sealed or otherwise obstructed so as to prevent passage of hot combustion gases through the gap 48.

In addition to sealing, the insert 50 can be configured to facilitate cooling of the metal aft segment 14. For instance, a coolant 60 can be supplied to the plenum 20. A portion of the coolant 60 can exit the plenum 20 through the passage 22 in the forward segment 12 and the passage 56 in the protrusion 52. The insert 50 can be configured according to embodiments of the invention to direct the coolant 60 over the exterior surfaces 62 of the metal aft segment 14. To that end, one or more cooling exit passages 64 can be provided within the insert 50. In one embodiment, the cooling passage 64 can be completely formed inside of the insert 50, as shown in FIG. 2A. In another embodiment, at least a part of the cooling passage 64 can be formed between the interface surface 26 of the aft segment 14 and the insert 50, as shown in FIG. 2B. Such a configuration can also be advantageous in that impingement cooling can be provided to at least a portion of the interface surface 26 of the aft segment 14.

In either case, the coupling insert 50 can include one or more cooling exit passages 64. The exit passages 64 can extend through the insert 50 and open to both the pressure and suction sides P, S of the vane assembly 10. Preferably, the coolant exit passages 64 can be oriented to eject onto the outer surfaces 62 of the aft segment 14 so as to form a film layer of coolant, thereby providing film cooling to the aft segment 14.

In one embodiment, the exit passages 64 can be substantially circular, but other cross-sectional geometries are possible. The exit passages 64 may or may not be substantially straight. Further, the cross-sectional area of the exit passages 64 can be substantially constant, or it can vary along the passages 64. There can be any of a number of exit passages 64. In the case of multiple exit passages 64, it is preferred if the exit passages 64 are radially spaced along the insert 50. In one embodiment, the exit passages 64 can be substantially equally spaced from each other. Alternatively, the exit passages 64 can be provided at any regular or irregular interval. The exit passages 64 can be substantially aligned in the radial direction, as shown in FIG. 4. Alternatively, at least one of the exit passages 64 can be offset from the other passages 64. Further, the exit passages 64 can be arranged in various ways. For instance, the exit passages 64 can be arranged in one or more radial columns.

Thus, by supplying a coolant 60 under high pressure, the coolant 60 can flush the exit passages 64 in the insert so as to substantially prohibit entry of the hot combustion gases. After leaving the exit passages 64, the coolant 60 can flow along the outer surfaces 62 of the aft segment 14 in a film layer. When the coolant 60 reaches the trailing edge 24, the coolant 60 can join the gas path in the turbine so as to substantially avoid creating any aerodynamic disturbances in the turbine gas path.

Embodiments of the invention shown in FIGS. 1-5 are suited for a wide range of applications, especially where it is possible to attach the aft segment to a support structure residing in the forward segment. However, in some instances, it may not be possible to attach a metal aft segment to a metal support in the forward segment. For instance, the forward segment can be a solid core hybrid CMC airfoil such as the airfoils disclosed in U.S. Pat. No. 6,709,230, which is incorporated herein by reference. While reducing internal pressure on the airfoil and increasing the overall robustness and structural integrity of the airfoil, such an arrangement makes attachment to an internal metal support no longer feasible because the volume inside the forward segment is filled with a solid core. Therefore, the aft segment must be supported at its ends, and the aft segment must be sufficiently rigid to handle the aerodynamic loads.

Thus, embodiments of the invention further relate to another system for attaching a separate metal airfoil segment in a vane assembly, as shown in FIGS. 6-9. Such an embodiment is especially suited for instances in which attachment of the aft segment to an internal support is not possible.

Figure 6:
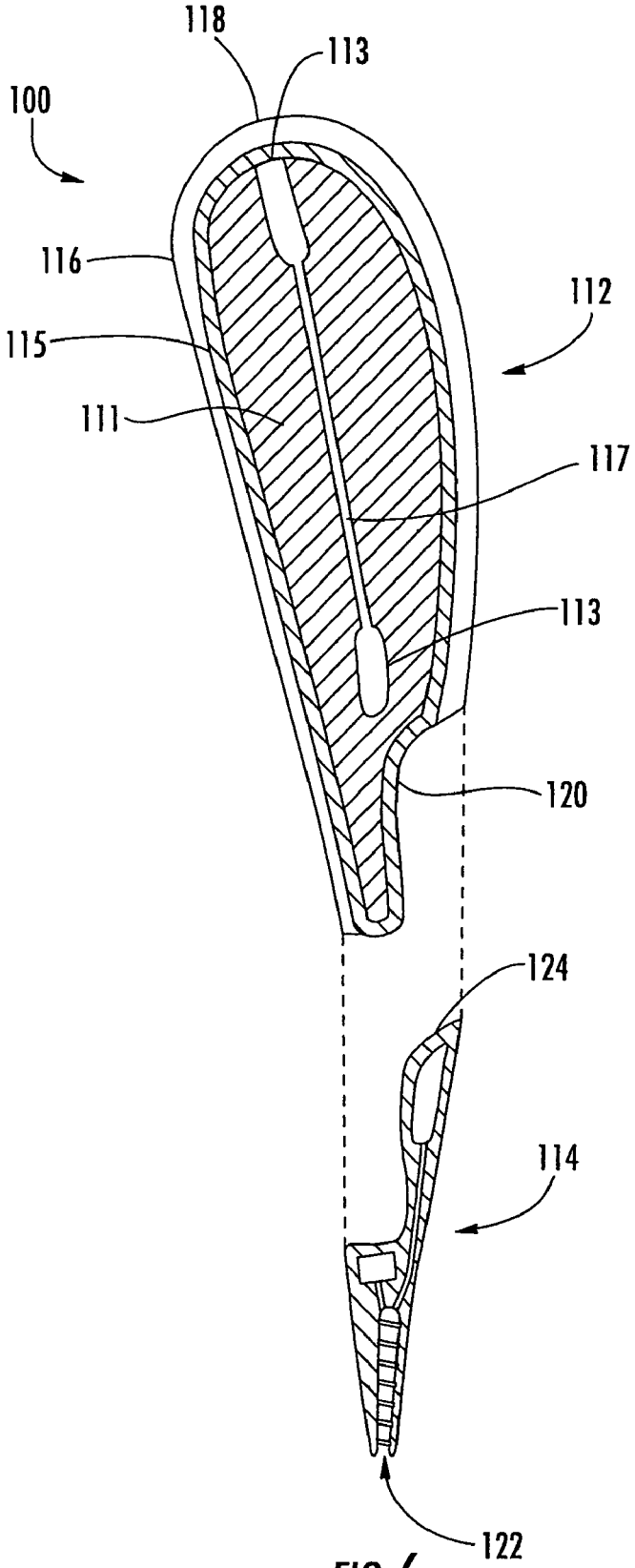
FIG. 6 is a top plan view of a forward airfoil segment and an aft airfoil segment of a vane assembly according to embodiments of the invention.

As shown in FIG. 6, a vane assembly 100 can include a forward airfoil segment 112 and an aft airfoil segment 114. Each of these segments 112, 114 can be radially elongated. The forward airfoil segment 112 can be generally airfoil-shaped. It will be understood that embodiments of the invention are not limited to any particular airfoil conformation. The forward segment 112 can include a substantially solid core 111, but it is not limited to being completely solid as the core 111 can include one or more plenums 113 used to provide cooling air. The plenums 113 can extend radially through the forward segment 112. The plenums 113 can also extend in the circumferential and/or axial directions. In the case of multiple plenums 113, at least some of the plenums can be in fluid communication by way of one or more cooling passages 117. The cooling passages 117 can be extend radially, axially, and/or circumferentially through the forward segment 112. The core 111 can be substantially surrounded by a ceramic wrap 115. At least a portion of the forward segment 112 can be coated with a thermal insulating material 116, such as a friable gradable insulation.

One end of the forward segment 112 can define the leading edge 118 of the vane assembly 100. The opposite end of the forward segment 112 can provide an interface surface 120. The interface surface 120 can have any of a number of configurations. Preferably, the interface surface 120 is substantially serpentine; that is, the interface surface 120 includes one or more curves or bends. As shown in FIG. 6, the interface surface 120 can be generally S-shaped. At least a portion of the interface surface 120 can be tapered. For example, the interface surface 120 can be tapered in the radial direction. Alternatively, the interface surface 120 can be tapered in the circumferential and/or axial directions of the turbine. Further, the interface surface 120 can include a compound taper, that is, the interface surface 120 can be tapered in more than one direction.

The forward airfoil segment 112 can be made of any of a number of materials. For instance, the forward airfoil segment 112 can be made of ceramics, ceramic matrix composites (CMC) or metals, just to name a few possibilities. Aspects of the invention are not limited to any particular material for the forward airfoil segment 112. It will be appreciated that the material selection for the forward segment 112 can dictate the manner in which the forward segment 112 is made.

Turning to the aft segment 114, it is preferred if the aft airfoil segment 114 is made of metal. The aft segment 114 can define the trailing edge 122 of the vane assembly 100. At the opposite end, the aft segment 114 can provide an interface surface 124. The interface surface 124 can have any of a number of configurations. For example, the interface surface 124 can be substantially serpentine including one or more curves or bends. Preferably, the interface surfaces 120, 124 are substantially matingly serpentine. In one embodiment, the interface surface 124 can be generally S-shaped. At least a portion of the interface surface 124 of the aft segment 114 can be tapered in one or more directions. The interface surface 124 of the aft segment 114 can substantially matingly correspond to the shape and taper of the interface surface 120 of the forward segment 112. Ideally, the tapers of the interface surfaces 120, 124 are closely toleranced.

It should be noted that the term "tapered" can mean that the interface surfaces 120, 124 are angled relative to at least one of the axes associated with the vane assembly 100. For example, a radial taper can mean that the interface surfaces 120, 124 of the forward and aft segments 112, 114 can be angled relative to the axis defining the radial direction R. Similarly, a circumferential taper can describe the interface surfaces 120, 124 being angled relative to the axis defining the circumferential direction C. An axial taper can describe the interface surfaces 120, 124 being angled relative to the axis defining the axial direction A. When the interfaces surfaces 120, 124 are angled relative to more than one of these axes, it is preferred if the interfaces surfaces 120, 124 are configured to be mating and, thus, substantially parallel to each other.

For reasons previously discussed, the aft segment 114 can be detached from the forward segment 112. Nonetheless, the segments 112, 114 can be positioned substantially proximate to each other such that a gap 126 is formed therebetween. For instance, the interface surface 120 of the forward segment 112 can be positioned substantially proximate to the interface surface 124 of the aft segment 114. For reasons discussed earlier, the gap 126 cannot remain between the forward and aft segments 112, 114 during engine operation, and the migration of hot gases through the gap 126 must be minimized.

In one embodiment, one or more sealing devices can fill at least a portion of the gap 126. The sealing devices can be attached to one of the interface surfaces 120, 124, or the sealing devices can be disposed in the gap 126 so as to bear against both interface surfaces 120, 124. The sealing device can be configured such that it forms a seal when compressed. In one embodiment, the sealing device can be a leaf spring 128. Alternatively, the sealing device can be a resilient insert, similar to coupling insert 50 discussed above. As will be explained more fully below, the matingly corresponding interface surfaces 120, 124 on the forward and aft segments 112, 114 can be used to trap the sealing devices in compression.

Figure 9:
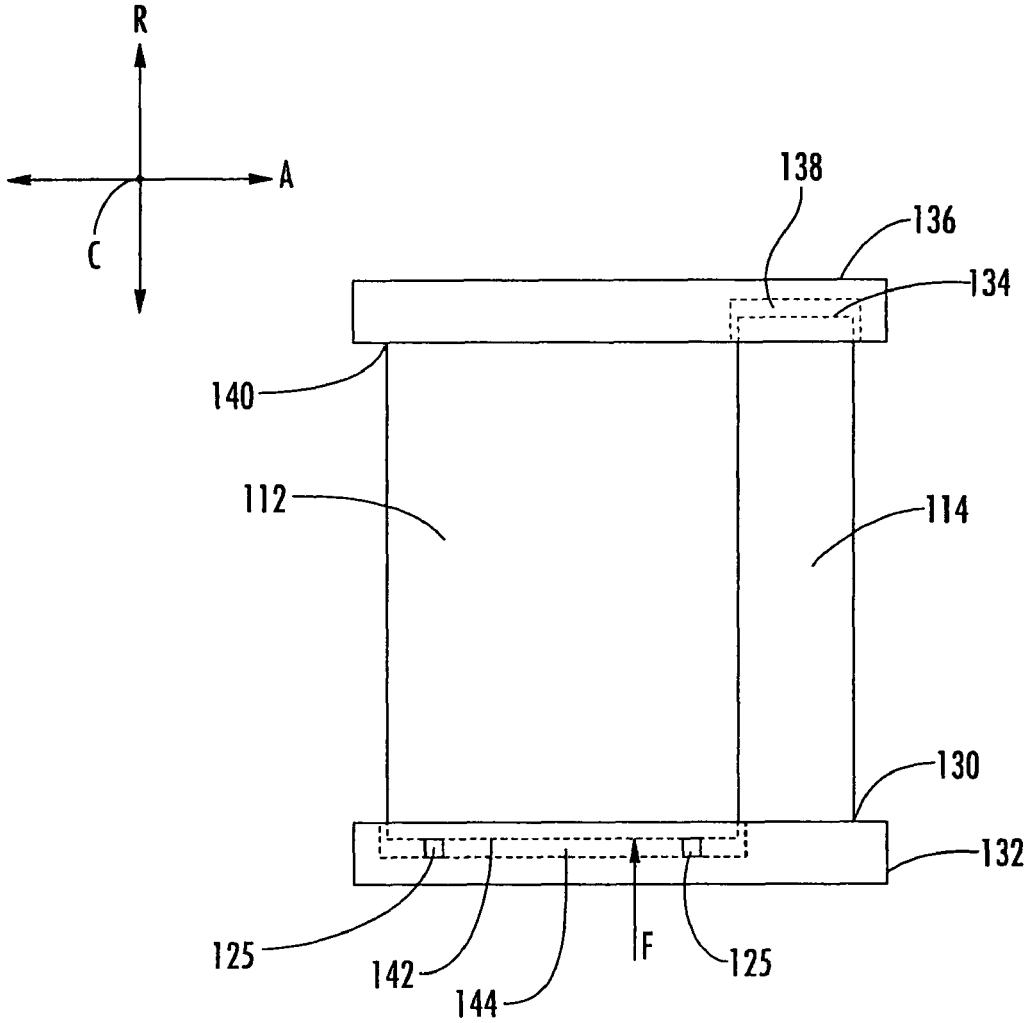
FIG. 9 is a side elevational view of the vane assembly of FIG. 5 according to embodiments of the invention.

Referring to FIG. 9, the aft segment 114 can be rigidly attached at one of its radial ends 130 to a shroud by, for example, welding. The shroud 132 can be made of substantially the same material as the aft segment 114 to facilitate such a fixed relation. At its other radial end 134, the aft segment 114 can be simply supported by a shroud 136 such that it is substantially constrained in the circumferential direction C and the axial direction A (of the turbine) while allowing movement of the aft segment 114 in the radial direction R due to thermal growth. In one embodiment, the shroud 136 can provide a recess 138 for receiving a portion of the aft segment 114 including the radial end 134. The recess 138 can be of a depth to allow thermal expansion of the aft segment 114, but the recess 138 can be sized to substantially constrain axial and circumferential movement of the aft segment 114.

In a similar manner, one radial end 140 of the forward segment 112 can be held in fixed relation to the shroud 136, such as by mechanical engagement, fasteners or welding. The shroud 136 can be made of substantially the same material as the forward segment 112 to facilitate such a rigid connection. The other radial end 142 of the forward segment 112 can be operatively associated with the other shroud 132 such that the forward segment 112 can be constrained in the circumferential and axial directions C, A while being free to slide in the radial direction R. Again, one manner of achieving such an operative association is by providing a recess 144 in the shroud 132 for receiving a portion of the forward segment 112 including the radial end 142. The foregoing engagement between the segments 112, 114 and shrouds 132, 140 can be used in connection with the shroud configuration shown in FIG. 5.

A clamping force F can be applied to one of the airfoil segments in the radial direction R. For example, when the interfaces surfaces 120, 124 are substantially matingly tapered in the radial direction R, application of the clamping force F on the forward airfoil segment 112 in the radial direction R can force the interface surface 120 toward the interface surface 124 of the aft segment 114. As a result, the sealing devices positioned in the gap 126 will oppose the clamping force F, thereby substantially locking the forward airfoil 112 segment in place. The clamping force F can be applied in various ways. For instance, the clamping force F can be achieved by pre-loading the forward segment 112 with a bolt. In one embodiment, shown in FIG. 9, the clamping force F can be applied by one or more radial springs 125 positioned in the recess 144 so as to operatively engage the end 142 of the forward airfoil segment 112 and the platform 132. The radial spring 125 can be attached to at least one of the forward airfoil segment 112 and the platform 132. It will be appreciated that the relative movement of forward segment 112 is coupled with the movements of the aft segment 114 by the interlocking arrangement of the tapers. Thus, the large fixed displacement separating the segments 112, 114 can be reduced. Further, the interface surfaces 120, 124 remain in compression, thereby increasing the sealing effectiveness. Thus, it will be appreciated that gas flow through the gap 126 can be substantially restricted.

Figure 7:
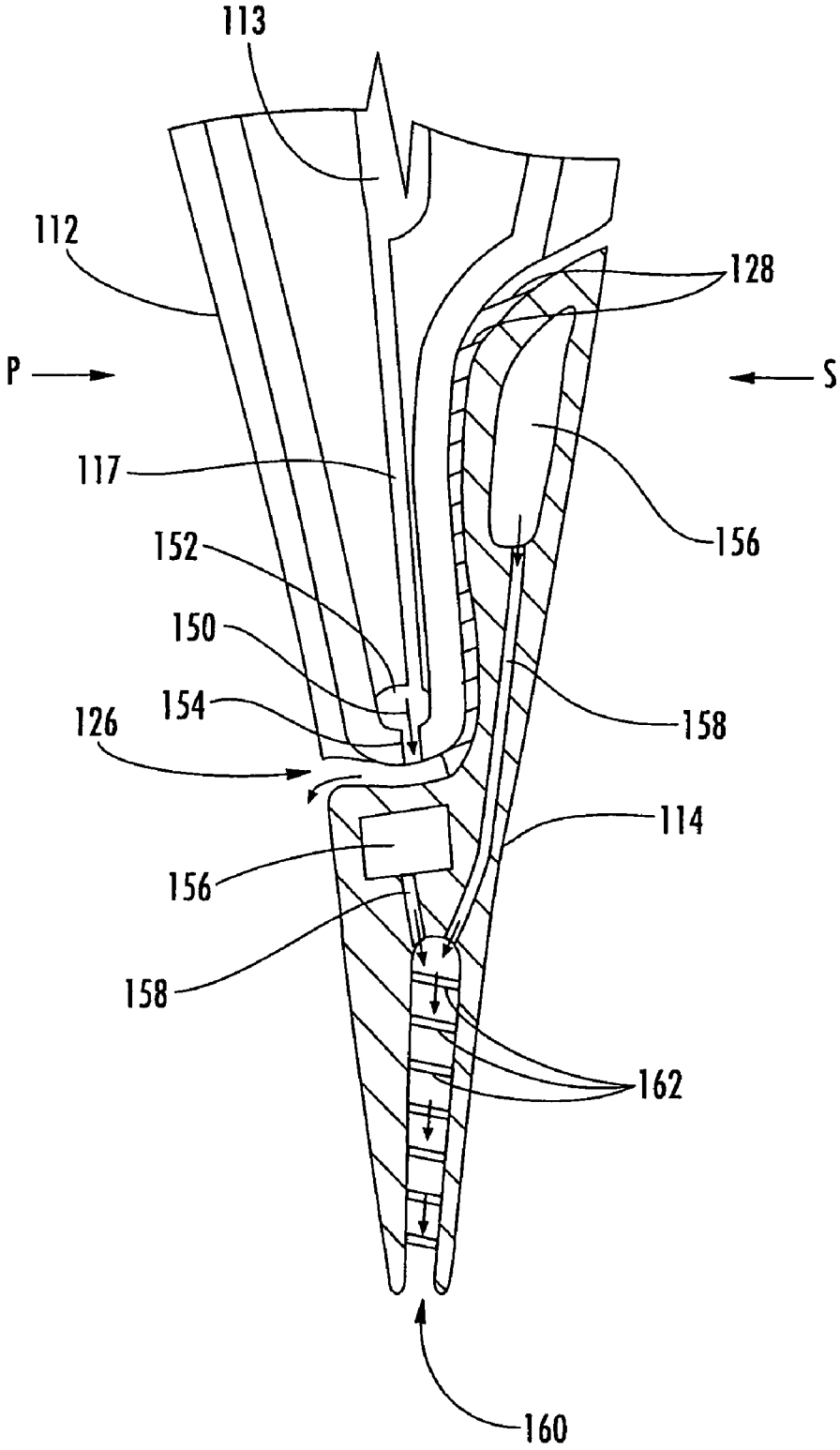
FIG. 7 is a close up view of the interface between a forward airfoil segment and a metal aft airfoil segment according to embodiments of the invention.
Figure 8:
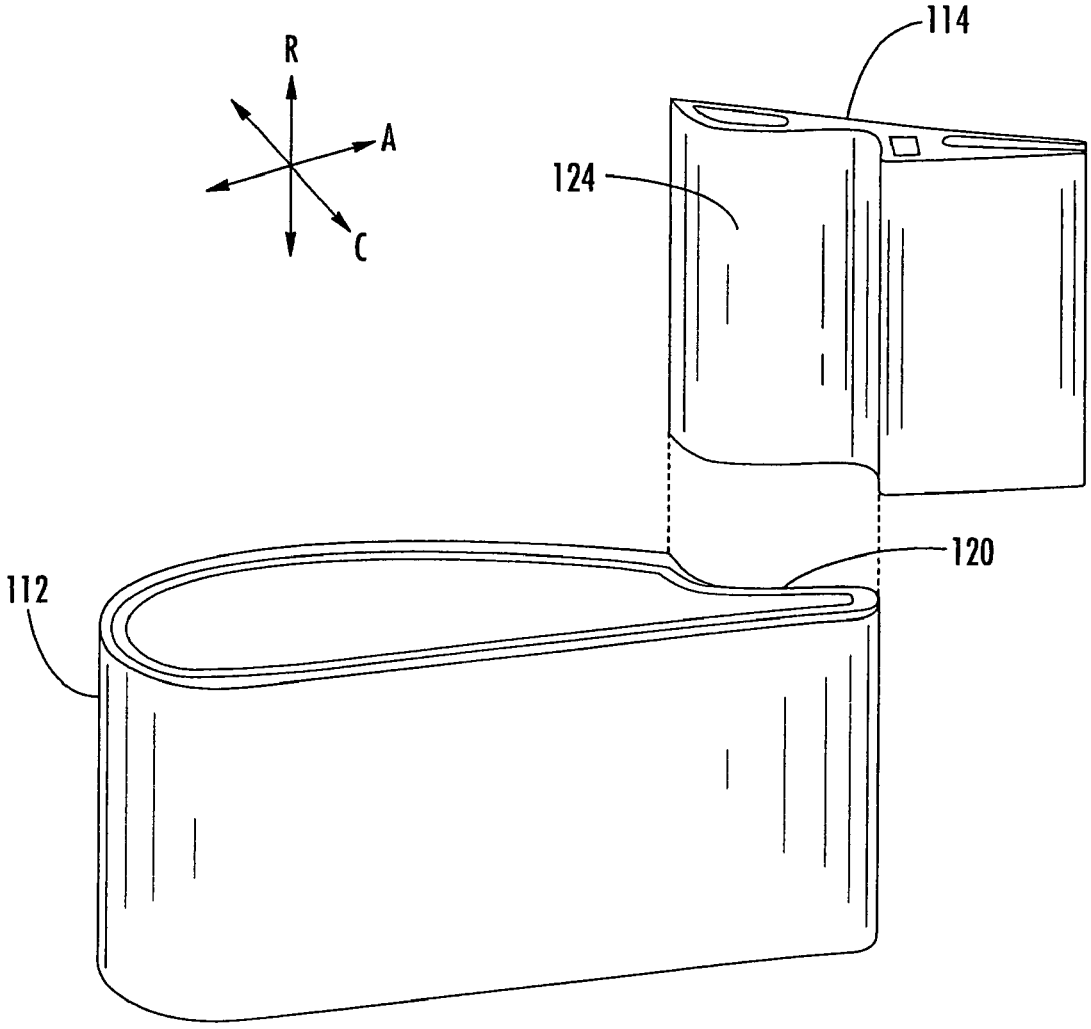
FIG. 8 is an exploded view of a forward airfoil segment and an aft airfoil segment according to embodiments of the invention.

In one embodiment, hot gas infiltration into the gap 126 can further be impeded by delivering pressurized coolant 150, such as air, to the gap 126. In one embodiment, as shown in FIG. 7, the forward segment 112 can include a coolant supply passage 152. The coolant supply passage 152 can be in fluid communication with one or more plenums 113 by way of at least one cooling passage 117. The supply passage 152 can be in fluid communication with the gap 126, such as by one or more passages 154. It should be noted that here the sealing devices can be positioned in the gap 126 on only one side of the passage 154. For example, the sealing devices may only be provided in the gap 126 on the suction side S of the passage 154, as shown in FIG. 7. In such case, coolant 150 entering the gap 126 will be naturally directed out the pressure side P of the gap 126. The flow of coolant 150 can further block the ingress of the hot gases into the gap 126.

The aft segment 114 can be configured to supply its own coolant through one or more supply plenums 156, as opposed to being cooled with coolant from the forward segment 112. Thus, at least one of the radial ends of each plenum 156 can be connected to a coolant source (not shown) that can be beyond the vane assembly 100. The supply plenums 156 can be sized such that a substantially uniform static pressure is achieved through the entire length of the plenum 156. Cooling air flow can be controlled by one or more channels 158 fluidly connecting the supply plenums 156 and a trailing edge exit chamber 160. The trailing edge exit chamber 160 can provide transverse members 162 to form a pin-fin cooling arrangement for the aft segment 114. The transverse members 162 can be cast into the aft segment 114.

Any of the above described vane assemblies can provide appreciable cooling air savings. In a full metal vane, it is estimated that the trailing edge region uses about 30 to 40 percent of the available cooling air. By comparison, a full hybrid CMC airfoil is estimated to use only about 10 percent of the cooling air of a metal vane. If cooling air from a forward CMC airfoil segment can be used to cool a metal aft segment, as described above, then it is expected that only about 30 to 40 percent of the air required for the full metal vane would be needed.

Further, the relatively small size of the metal aft segment can yield additional benefits. For example, it will be readily appreciated that it is much easier to cast a relatively small aft segment as opposed to an entire metal vane. Moreover, smaller segments are amenable to intricate features being cast in the segment. Such intricate features can be used to achieve efficient cooling systems for the aft segment. In addition, the trailing edge can be made thinner and longer, thereby improving aerodynamic performance.

The foregoing description is provided in the context of two possible systems for attaching a metal aft airfoil segment to a forward segment made of a dissimilar material. It will of course be understood that the invention is not limited to the specific details described herein, which are given by way of example only, and that various modifications and alterations are possible within the scope of the invention as defined in the following claims.

What is claimed is:

1. An airfoil assembly comprising:

a forward airfoil segment defining the leading edge of the airfoil assembly at one end and providing an interface surface at an opposite end;

an aft airfoil segment defining the trailing edge of the airfoil assembly at one end and providing an interface surface at the opposite end, the aft airfoil segment being made of metal, wherein the interface surfaces of the airfoil segments are positioned substantially proximate to each other so as to form a gap therebetween; and a sealing device positioned in at least a portion of the gap, wherein the interface surface of the forward segment substantially matingly corresponds to the interface surface of the aft segment such that at least the interface surfaces hold the sealing device in compression, whereby the sealing device substantially seals the gap and provides compliance between the forward and aft airfoil segments, and wherein the forward airfoil segment does not directly contact the aft airfoil segment.

2. The assembly of claim 1 wherein the sealing device is one of a leaf spring and a resilient insert.

3. The assembly of claim 1 wherein the interface surfaces are substantially matingly serpentine, whereby the serpentine interface surfaces create a tortuous gap between the forward and aft airfoil segments so as to impede flow through the gap.

4. The assembly of claim 1 wherein the forward airfoil segment is made of one of ceramic, ceramic matrix composite, metal, or single crystal super alloy.

5. The assembly of claim 1 wherein the forward airfoil segment includes a substantially solid core surrounded by a ceramic matrix composite wrap.

6. The assembly of claim 1 wherein the aft segment includes a coolant supply plenum and an exit chamber, wherein the exit chamber opens to the trailing edge of the vane assembly, and wherein the coolant supply plenum is in fluid communication with the exit chamber.

7. The assembly of claim 6 wherein the exit chamber includes a series of transverse rods, whereby a pin-fin cooling array is formed.

8. The assembly of claim 1 wherein at least a portion of each of the interface surfaces is substantially correspondingly tapered in the radial direction.

9. The assembly of claim 8 wherein the forward airfoil segment is radially biased such that the respective interface surface is urged toward the other interface surface, whereby the sealing device is held in compression.

10. The assembly of claim 1 further including a first shroud and a second shroud, wherein the aft segment includes opposing radial ends, wherein one radial end of the aft segment is fixed to the first shroud, and wherein the opposite radial end of the aft segment operatively engages the second shroud so as to permit radial movement of the aft segment relative to the second shroud, whereby thermal expansion of the aft segment in the radial direction is accommodated.

11. An airfoil assembly comprising:

a forward airfoil segment defining the leading edge of the airfoil assembly at one end and providing an interface surface at an opposite end;

an aft airfoil segment defining the trailing edge of the airfoil assembly at one end and providing an interface surface at the opposite end, the aft airfoil segment being made of metal, wherein the interface surfaces of the airfoil segments are positioned substantially proximate to each other so as to form a gap therebetween, wherein the axial length of the aft airfoil segment is substantially shorter than the axial length of the forward airfoil segment; and a sealing device positioned in at least a portion of the gap, wherein the interface surface of the forward segment substantially matingly corresponds to the interface surface of the aft segment such that at least the interface surfaces hold the sealing device in compression, whereby the sealing device substantially seals the gap and provides compliance between the forward and aft airfoil segments.

* * * * *